US008353429B2

(12) United States Patent
Zhou et al.

(10) Patent No.: US 8,353,429 B2
(45) **Date of Patent: *Jan. 15, 2013**

(54) DISPENSING APPARATUS

(75) Inventors: Hai-Bo Zhou, Shenzhen (CN); Zhi-Ming Zhao, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/095,041

(22) Filed: Apr. 27, 2011

(65) Prior Publication Data

US 2011/0284581 A1 Nov. 24, 2011

(30) Foreign Application Priority Data

May 18, 2010 (CN) ..... 2010 1 0175456

(51) Int. Cl.
*B65D 47/00* (2006.01)

(52) U.S. Cl. ..... 222/181.2; 222/390; 222/504; 222/547; 222/559; 222/256

(58) Field of Classification Search ..... 222/180, 222/181.1, 181.2, 181.3, 256, 262, 263, 390, 222/413, 504, 559, 571; 251/122
See application file for complete search history.

(56) References Cited

U.S. PATENT DOCUMENTS

| | | | | |
|---|---|---|---|---|
| 5,073,993 | A * | 12/1991 | Dewaal | 4/227.1 |
| 5,137,187 | A * | 8/1992 | Nichols et al. | 222/504 |
| 5,788,128 | A * | 8/1998 | Hickey | 222/504 |
| 6,089,413 | A * | 7/2000 | Riney et al. | 222/318 |
| 6,443,335 | B1 * | 9/2002 | Pinedjian et al. | 222/504 |
| 7,052,549 | B2 * | 5/2006 | Chambers et al. | 118/313 |
| 2002/0077588 | A1 * | 6/2002 | Schneider et al. | 604/82 |
| 2003/0155384 | A1 * | 8/2003 | Nagahata et al. | 222/504 |
| 2005/0224513 | A1 * | 10/2005 | Strong et al. | 222/1 |
| 2005/0242313 | A1 * | 11/2005 | Kronholm | 251/124 |
| 2006/0070428 | A1 * | 4/2006 | Bateson et al. | 73/54.32 |
| 2006/0108383 | A1 * | 5/2006 | Byerly | 222/504 |
| 2006/0124672 | A1 * | 6/2006 | Penalver Garcia | 222/504 |
| 2006/0157517 | A1 * | 7/2006 | Fiske et al. | 222/504 |
| 2007/0113924 | A1 * | 5/2007 | Phillips, Jr. | 141/351 |
| 2009/0095725 | A1 * | 4/2009 | Ohashi et al. | 219/202 |
| 2009/0140003 | A1 * | 6/2009 | Fontaine et al. | 222/1 |
| 2009/0166386 | A1 * | 7/2009 | Morand | 222/559 |
| 2009/0242590 | A1 * | 10/2009 | Saveliev et al. | 222/509 |
| 2011/0095056 | A1 * | 4/2011 | Liu | 222/387 |

FOREIGN PATENT DOCUMENTS

| | | | |
|---|---|---|---|
| CN | 2720622 | Y | 8/2005 |
| CN | 101224454 | A | 7/2008 |
| CN | 201504387 | U * | 6/2010 |

* cited by examiner

*Primary Examiner* — Kevin P Shaver
*Assistant Examiner* — Patrick M Buechner
(74) *Attorney, Agent, or Firm* — Altis Law Group, Inc.

(57) ABSTRACT

A dispensing apparatus includes a support frame, a receiving tube, a dispenser, a slide rail, a screw rod, a driving assembly, and a push piston. The receiving tube is fixed to the support frame. The receiving tube defines a tube cavity for receiving glue materials, and an output tube communicating with the receiving tube. The dispenser is connected to the receiving tube. A slide rail is fixed on the support frame, and a sliding member is slidably connected to the slide rail. A screw rod engages with the sliding member. A driving assembly drives a screw rod to move. A push piston is fixed on the sliding member, and is partially received in the receiving tube for pushing glue materials to flow to the dispenser.

15 Claims, 10 Drawing Sheets

DISPENSING APPARATUS

BACKGROUND

1. Technical Field

The present disclosure relates generally to glue material dispensers, and especially to a dispensing apparatus for glue.

2. Description of Related Art

Dispensing apparatuses are commonly used for the application of glue or other glue material onto a workpiece. The dispensing apparatus often includes a nozzle valve for controlling the supply of glue material, and a nozzle connected to the nozzle valve for dispensing glue material. However, a small volume of glue material can escape through the nozzle even after the nozzle valve is closed. Residual glue material can accumulate on the workpiece, requiring cleaning steps to be added to the process. Furthermore, maintenance of the dispensing apparatus is necessary.

One solution has been the use of a pneumatic controller connected to the nozzle valve. When the nozzle valve is closed, the pneumatic controller evacuates the air from the nozzle valve, thereby retracting existing glue material back into the apparatus. However, the inclusion of the pneumatic controller renders the dispensing apparatus bulky, complicated, and costly to manufacture.

Therefore, a dispensing apparatus which overcomes the described limitations is desired.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION

Figure 1:
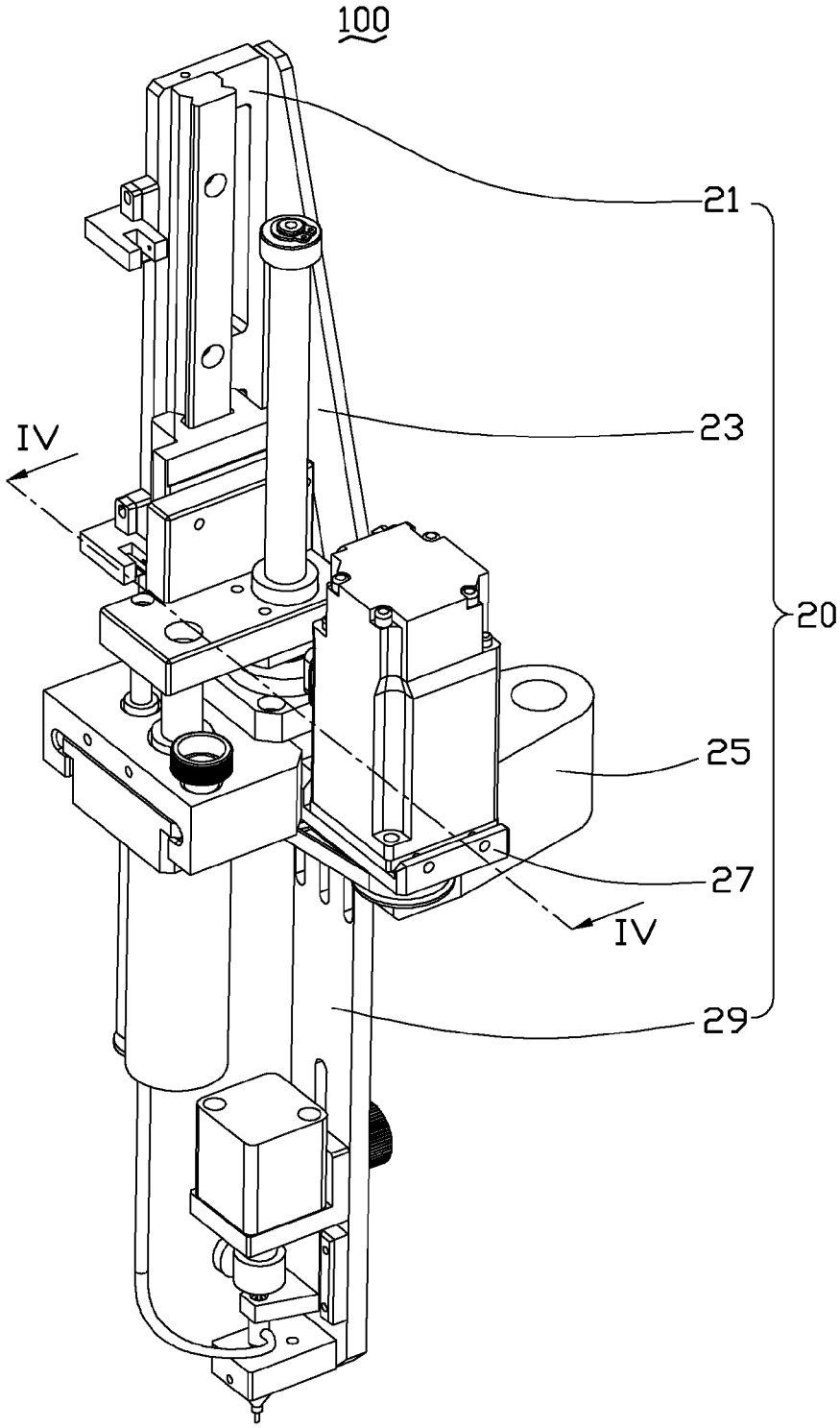
FIG. 1 is an assembled, isometric view of a first embodiment of a dispensing apparatus, which includes a support frame, a driving assembly, a transferring assembly, and a dispensing assembly.
Figure 2:
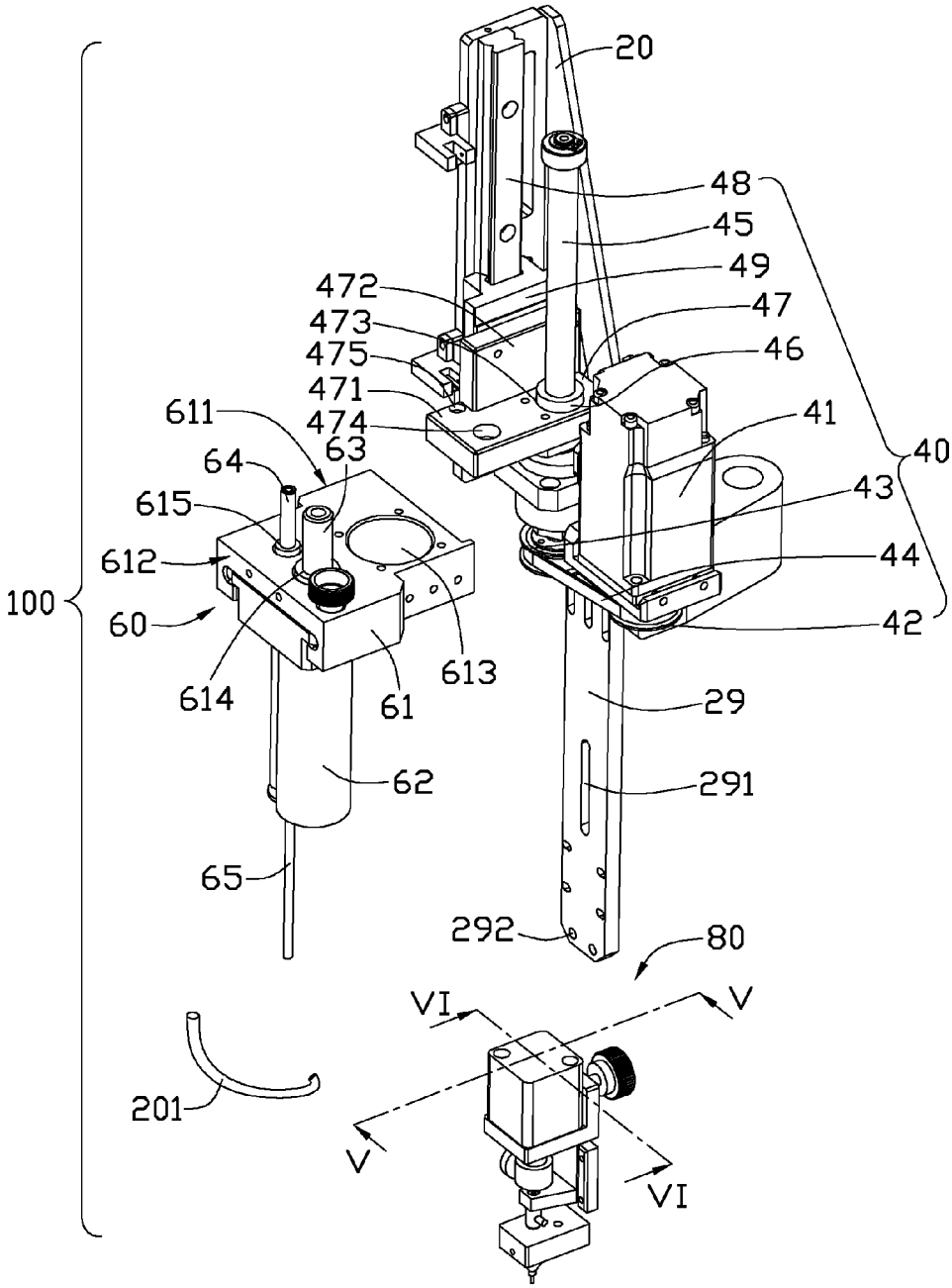
FIG. 2 is an exploded, isometric view of the dispensing apparatus of FIG. 1.
Figure 3:
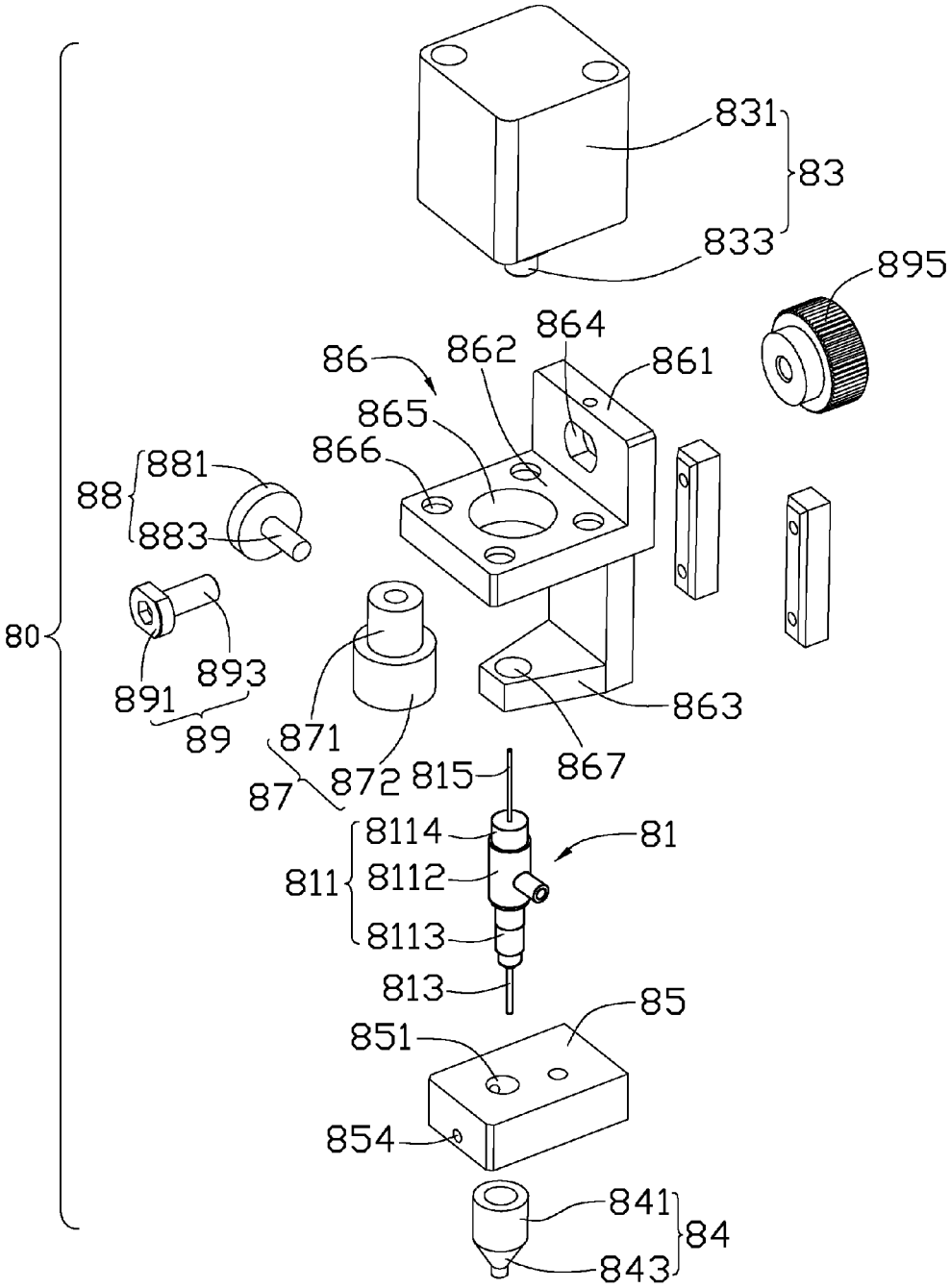
FIG. 3 an exploded, isometric view of the dispensing assembly of FIG. 1.

Referring to FIGS. 1 and 2, a first embodiment of a dispensing apparatus 100 includes a support frame 20, a driving assembly 40, a transferring assembly 60, and a dispensing assembly 80. The dispensing assembly 80 and the driving assembly 40 are fixed to the support frame 20. The driving assembly 40 is configured to drive the dispensing assembly 80.

The support frame 20 includes a guide plate 21, a reinforced plate 23, a connecting member 25, a first fixing plate 27, and a second fixing plate 29. In the illustrated embodiment, the guide plate 21 is substantially rectangular, and the reinforced plate 23 is substantially triangular and extending substantially perpendicular from a side of the guide plate 21. The first fixing plate 27 is substantially perpendicular to and connects the reinforced plate 23 and the guide plate 21. The second fixing plate 29 defines a restricting groove 291 in a middle portion, and a fixing hole 292 in an end portion. The reinforced plate 23 and the second fixing plate 29 are fixed to an end of the connecting member 25, and positioned on opposite sides of the connecting member 25.

The driving assembly 40 includes a driving motor 41, a driving wheel 42, an action wheel 43, a belt 44, a screw rod 45, a sliding member 46, a transition member 47, a slide rail 48, and a slide saddle 49. The driving motor 41 is fixed on the first fixing plate 27. The driving wheel 42 is connected to the driving motor 41. The belt 44 is sleeved on the driving wheel 42 and the action wheel 43, such that the driving wheel 42 can drive the action wheel 43 to rotate. An end of the screw rod 45 is fixed to the action wheel 43, and the sliding member 46 is engaged with the screw rod 45. The transition member 47 is substantially L-shaped, and includes a first transition portion 471 and a second transition portion 472 substantially perpendicular to the first transition portion 471. The first transition portion 471 defines a receiving hole 473 in a first end for partially receiving the sliding member 46, and defines a first connecting hole 474 and a second connecting hole 475 in a second end opposite to the first end. The slide rail 48 is fixed on the guide plate 21 and is substantially parallel to the screw rod 45. The slide saddle 49 is slidably engaged with the slide rail 48.

Figure 4:
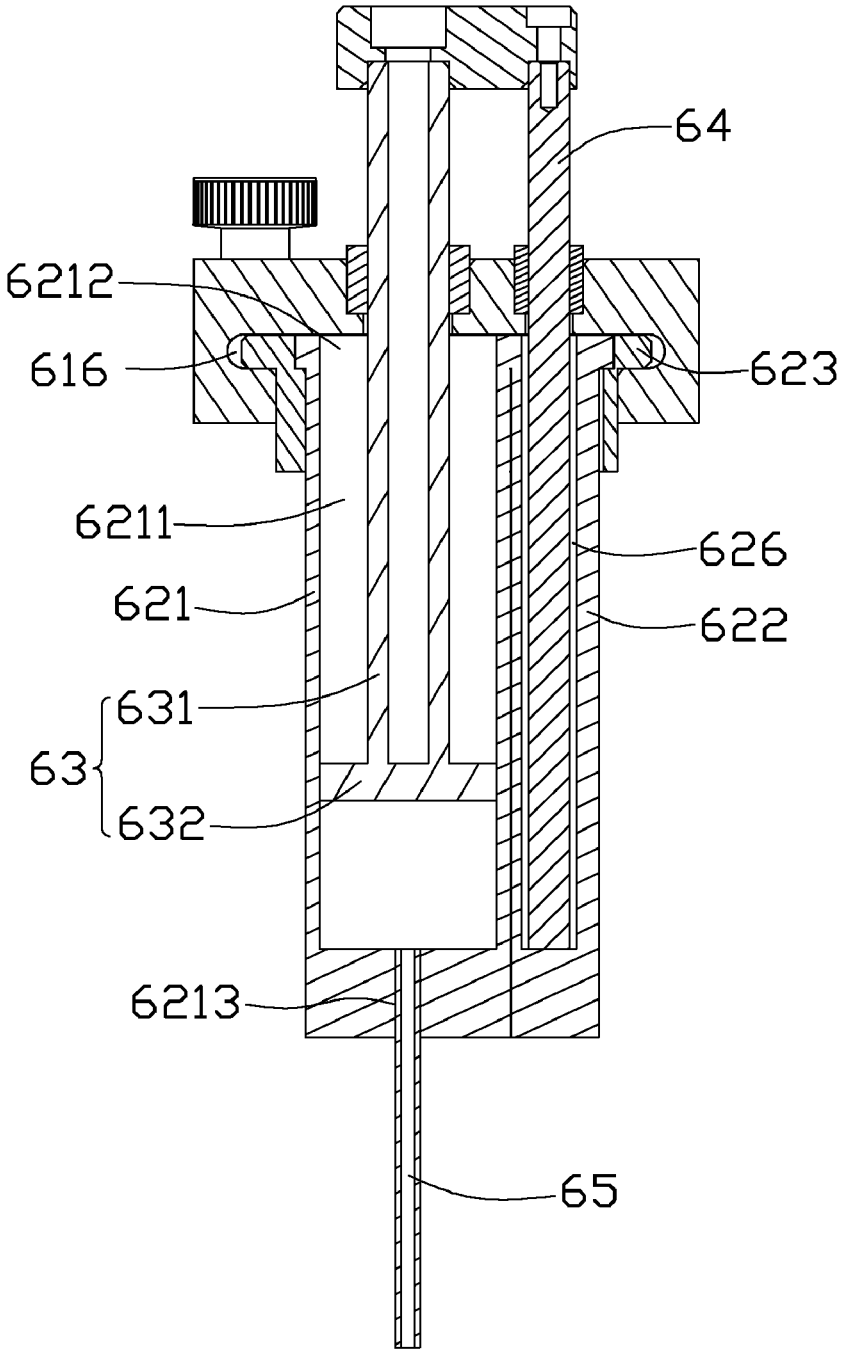
FIG. 4 is a cross-section of the transferring assembly taken along line IV-IV of FIG. 1.
Figure 5:
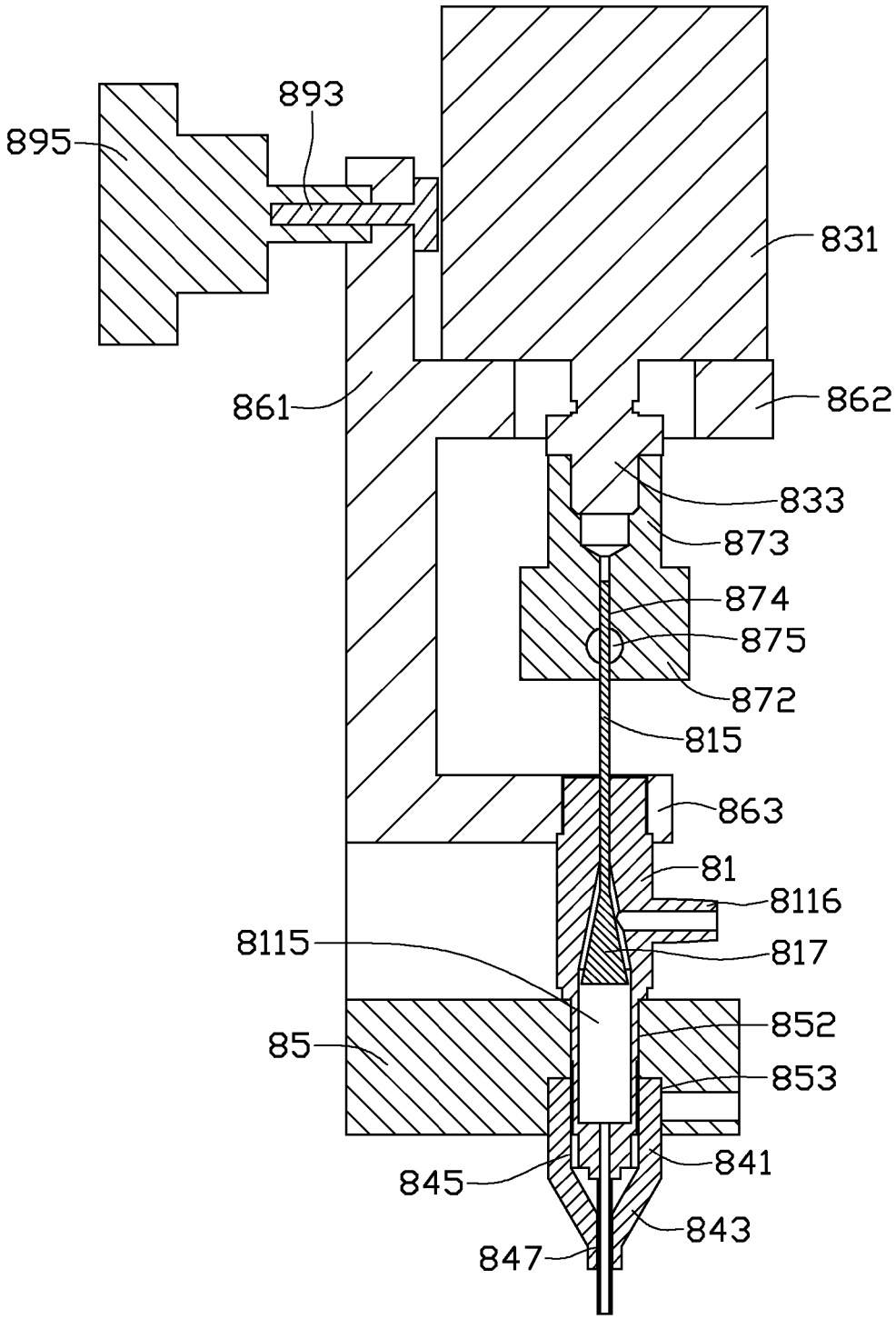
FIG. 5 is a cross-section of the dispensing assembly taken along line V-V of FIG. 2.
Figure 6:
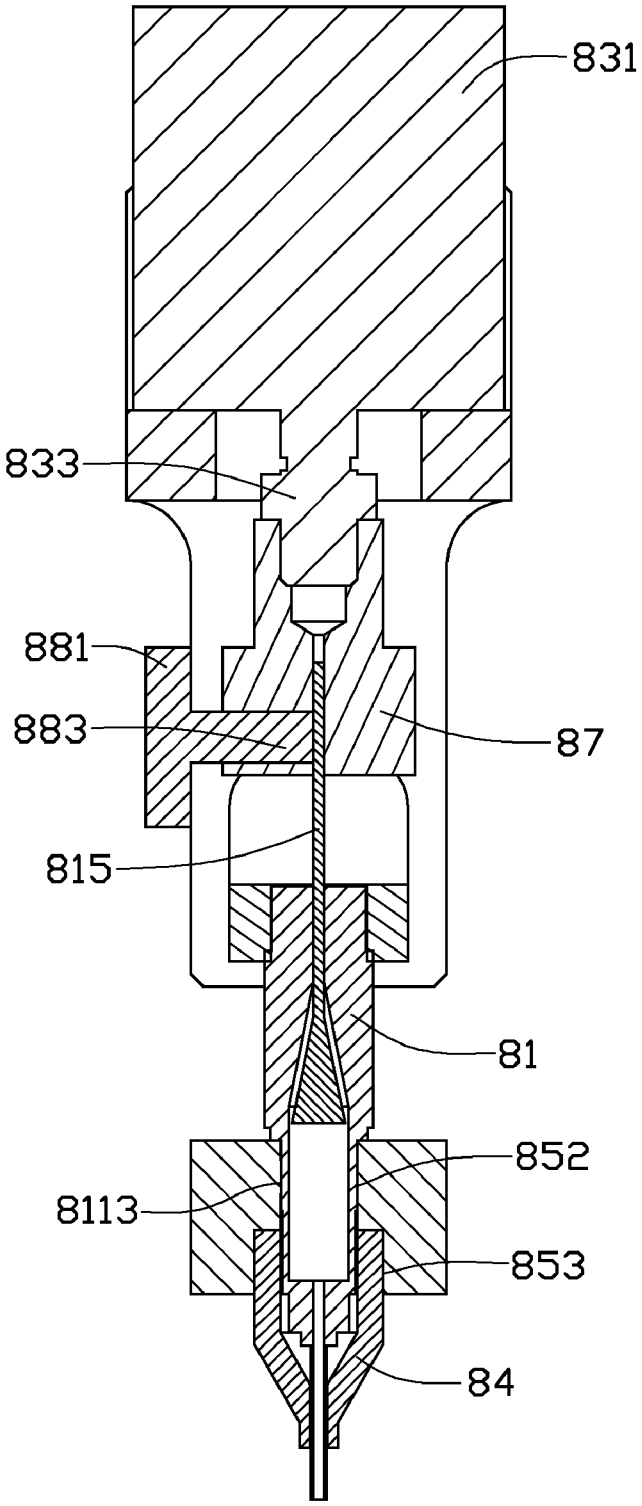
FIG. 6 is a cross-section of the dispensing assembly taken along line VI-VI of FIG. 2.

Referring to FIGS. 2 and 4, the transferring assembly 60 includes a fixed base 61, a receiving tube 62, a push piston 63, a guide rod 64, and an output tube 65. The fixed base 61 includes an end surface 611, and a side surface 612 substantially perpendicular to the end surface 611. The end surface 611 defines a through hole 613, a first guiding hole 614, and a second guiding hole 615. The side surface 612 defines an assembly groove 616. The assembly groove 616 has a substantially T-shaped cross-section, and communicates with the first guiding hole 614 and the second guiding hole 615.

The receiving tube 62 includes a main body 621, a guiding portion 622, and an assembly portion 623. The guiding portion 622 and the assembly portion 623 are formed on opposite sides of the main body 621. The main body 621 defines a tube cavity 6211, an opening 6212, and an output hole 6213. The opening 6212 and the output hole 6213 respectively communicate with opposite sides of the tube cavity 6211. The guiding portion 622 defines a guiding groove 626. The assembly portion 623 is substantially T-shaped, and received in the assembly groove 616 of the fixed base 61. The opening 6212 communicates with the first guiding hole 614, and the guiding groove 626 communicates with the second guiding hole 615.

The push piston 63 includes a shaft portion 631 and a piston portion 632 formed on an end of the shaft portion 631. The piston portion 632 is received in the tube cavity 6211 and extends through the first guiding hole 614, and is fixed to the first connecting hole 474 of first transition portion 471. The guide rod 64 extends through the second guiding hole 615 and the guiding groove 626, and is fixed in the second connecting hole 475 of the first transition portion 471. The output tube 65 is partially received in the output hole 6213 of the receiving tube 62.

Referring to FIGS. 3 and 5 through 7, the dispensing assembly 80 includes a dispenser 81 and a driving device 83.

The dispenser 81 includes a nozzle valve 811, a nozzle 813, an actuating shaft 815, and a valve plug 817. The nozzle valve 811 may be a substantially hollow cylinder, and includes a main body 8112, and a first latching portion 8113 and a second latching portion 8114 formed at the opposite ends of the main body 8112. The nozzle valve 811 defines a receiving cavity 8115. The receiving cavity 8115 includes a first receiving portion 8117 defined in the main body 8112 and a second receiving portion 8118 defined in the first latching portion 8113 communicating with the first receiving portion 8117. The first receiving portion 8117 can be substantially conical with a gradually increasing diameter from an upper end to a lower end thereof. The second receiving portion 8118 can be substantially cylindrical. The nozzle valve 811 further includes an inlet tube 8116 formed on a side surface of the main body 8112. The nozzle valve 811 defines an inlet opening 8123 on a sidewall of the first receiving portion 8117. The inlet tube 8116 defines a channel 8121 communicating with the inlet opening 8123.

The nozzle 813 may be a substantially thin hollow tube connected to one end of the first latching portion 8113. The nozzle 813 communicates with the second receiving portion 8118.

The valve plug 817 is located inside the receiving cavity 8115 of the nozzle valve 811. The valve plug 817 is shaped similar to the first receiving portion 8117, also with a width gradually increasing towards the nozzle 813. At its widest width, the width of the valve plug 817 is narrower than a diameter of the second receiving portion 8118, such that an annular gap 8124 is defined between an end of the valve plug 817 and the sidewall of the second receiving portion 8118. Glue materials can flow from the first receiving portion 8117 to the second receiving portion 8118 through the gap 8124.

A lower end of the actuating shaft 815 extends through the second latching portion 8114 of the nozzle valve 811, and the actuating shaft 815 is fixed to the valve plug 817, enabling the actuating shaft 815 to drive the valve plug 817 away from or closer to the nozzle 813.

In the first embodiment, the driving device 83 is a pneumatic cylinder, and includes a cylinder body 831 and a piston shaft 833. The piston shaft 833 is movably connected to the cylinder body 831.

The dispensing apparatus 100 further includes a nozzle sleeve 84 configured to protect the nozzle 813, and a fixing member 85 configured to fix the nozzle sleeve 84 to the support frame 20.

The nozzle sleeve 84 includes a fixing portion 841, which can be substantially cylindrical, and a protecting portion 843, which is substantially tapered and connected to the fixing portion 841. The fixing portion 841 defines a receiving groove 845 to receive the first latching portion 8113 of the nozzle valve 811. The protecting portion 843 defines a through hole 847 to receive the nozzle 813.

The fixing member 85 can be substantially rectangular and fixed to the second fixing plate 29 by for example, two fasteners (not shown) received in the corresponding two fixing holes 292. The fixing member 85 defines a through hole 851 in a middle portion of the fixing member 85. The through hole 851 includes a first holding portion 852 to receive the first latching portion 8113 of the nozzle valve 811, and a second holding portion 853 to receive the fixing portion 841 of the nozzle sleeve 84. The fixing member 85 further defines a threaded hole 854 on a side surface of the fixing member 85 communicating with the first holding portion 852.

Referring to FIG. 3 again, the dispensing apparatus 100 further includes a supporting member 86, a connecting sleeve 87, a first fastening member 88, and a second fastening member 89.

The supporting member 86 includes a base 861, a first supporting board 862 extending substantially perpendicularly from a middle portion of the base 861, and a second supporting board 863 extending substantially perpendicularly from an end of the base 861. The base 861 defines a pin hole 864 adjacent to a top end of the base 861. The first supporting board 862 defines a through hole 865 in a middle portion to receive the piston shaft 833 of the driving device 83. The first supporting board 862 further defines four fixing holes 866 arranged along a circumference of the through hole 865. The cylinder body 831 of the driving device 83 is fixed to the first supporting board 862 by for example, four fasteners (not shown) received in the corresponding four fixing holes 866. The second supporting board 863 defines a fixing hole 867 for receiving the second latching portion 8114 of the nozzle valve 811.

The connecting sleeve 87 includes a first connecting portion 871 and a second connecting portion 872 connected to the first connecting portion 871. The first connecting portion 871 defines a first latching cavity 873 to receive the piston shaft 833 of the driving device 83. The second connecting portion 872 defines a second latching cavity 874 communicating with the first latching cavity 873 to receive the actuating shaft 815. The second connecting portion 872 further defines a threaded hole 875 on a side surface of the second connecting portion 872 communicating with the second latching cavity 874.

The first fastening member 88 includes an operating portion 881, which can be disk-shaped, and a threaded portion 883 connected to the operating portion 881 received in the threaded hole 875 of the connecting sleeve 87.

The second fastening member 89 includes a fixing head 891 corresponding to the pin hole 864 of the supporting member 86, a threaded pole 893, and a mating fastener 895, such as a nut. The threaded pole 893 extends the pin hole 864 of the supporting member 86, the restricting groove 291 of the second fixing plate 29, and engages with the mating fastener 895, thereby fixing the supporting member 86 to the second fixing plate 29.

Referring to FIGS. 1 through 7, the driving device 83 is fixed to the supporting member 86. The connecting sleeve 87 is fixed to the piston shaft 833 of the driving device 83. The nozzle sleeve 84 is fixed in the second holding portion 853 of the fixing member 85, and then the fixing member 85 is fixed to the second fixing plate 29 via fasteners such as screws.

The actuating shaft 815 of the dispenser 81 passes through the fixing hole 867 of the second supporting board 863, and then the second latching portion 8114 of the nozzle valve 811 is fixed in the fixing hole 867. The operating portion 881 of the first fastening member 88 is rotated, such that the threaded portion 883 enters in the threaded hole 875, and resists the actuating shaft 815. Therefore, the actuating shaft 815 is firmly fixed to the piston shaft 833 of the driving device 83 via the connecting sleeve 87, and the driving device 83 is capable of moving the actuating shaft 815 and the valve plug 817 upward or downward relative to the nozzle valve 811.

The threaded pole 893 of the second fastening member 89 passes through the restricting groove 291 of the second fixing plate 29, and engages in the pin hole 864 of the supporting member 86, such that the supporting member 86 as well as the dispenser 81 and the driving device 83 are fixed to the second fixing plate 29. The first latching portion 8113 of the nozzle valve 811 latches inside the first holding portion 852 of the fixing member 85, and the nozzle 813 passes through the through hole 847 protruding from the nozzle sleeve 84. A fastener such as a screw (not shown) engages in the threaded hole 854 and abuts the first latching portion 8113 of the nozzle valve 811. Thus, the dispenser 81 is firmly fixed between the fixing member 85 and second supporting board 863. The output tube 65 is connected to the inlet tube 8116 via a pipe 201, thereby completing the assembly of the dispensing apparatus 100.

Figure 7:
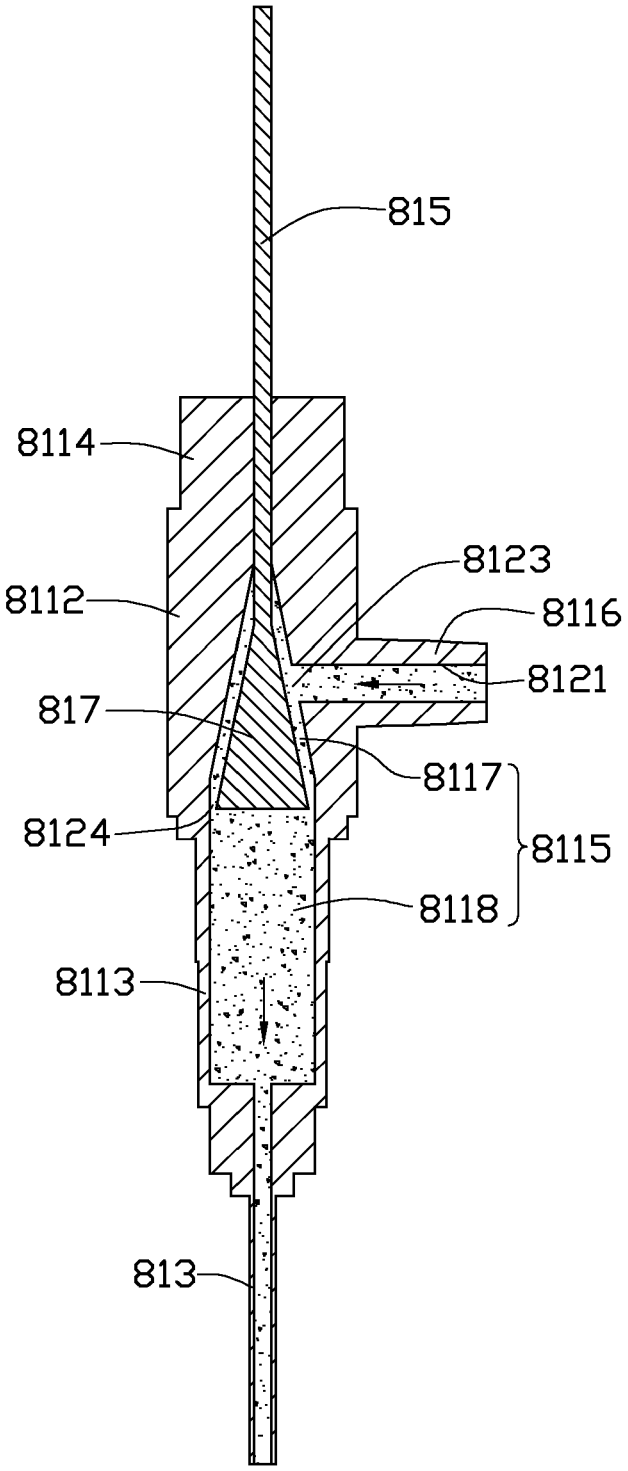
FIG. 7 is a cross-section of a dispenser of FIG. 6 in an open state.

In use, the driving motor 41 drives the screw rod 45 to rotate, such that the sliding member 46 together with the transition member 47 slide along the slide rail 48. Therefore, the piston portion 632 of the push piston 63 that is fixed on the transition member 47 moves in the tube cavity 6211, thereby pushing glue in the tube cavity 6211 to flow out of the output tube 65 and enter the dispenser 81 via the inlet tube 8116. When the dispenser 81 is turned on as shown in FIG. 7, the valve plug 817 of the dispenser 81 is positioned between the first receiving portion 8117 and the second receiving portion 8118 and the inlet opening 8123 is opened. Glue material can be discharged from the channel 8121 to the first receiving portion 8117, and then flow to the second receiving portion 8118 through the gap 8124, and is dispensed through the outlet opening 813 of the nozzle 813.

Figure 8:
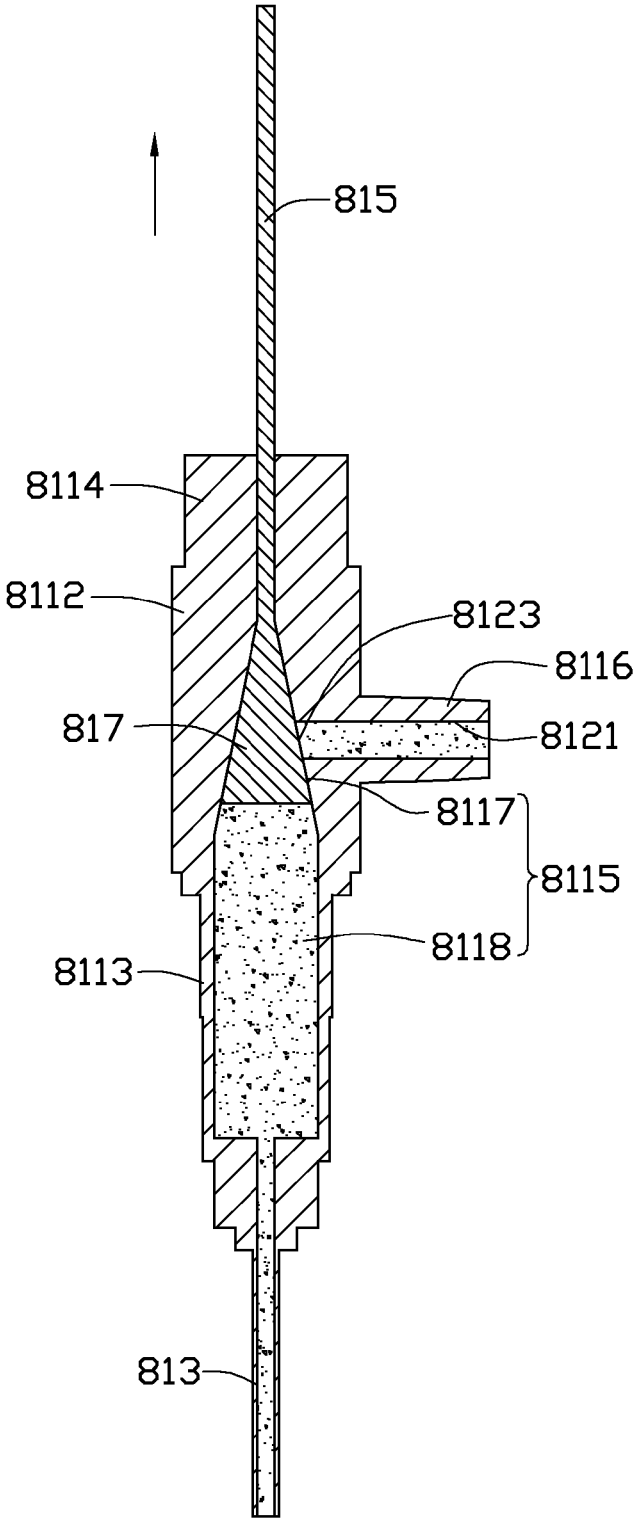
FIG. 8 is similar to FIG. 7, but the dispenser in a closed state.

Referring to FIG. 8, when the dispenser 81 is to be turned off (closed), the actuating shaft 815 is moved immediately upward by the piston shaft 833 of the driving device 83, such that the valve plug 817 moves away from the nozzle 813 and enters the first receiving portion 8117 entirely. The valve plug 817 then abuts a sidewall of the first receiving portion 8117 and seals the inlet opening 8123. When the valve plug 817 moves upwards, a small volume of glue material is pushed back into the channel 8121 of the inlet tube 8116, such that a lowered hydraulic pressure is provided to the glue material in the second receiving portion 8118, and the glue material inside the outlet opening 813 is retracted to the nozzle 813, thereby providing a clean cut off. The dispenser 81 can easily return to the on (open) state again by driving the valve plug 817 near the nozzle 813 to open the inlet opening 8123.

Glue material inside the dispenser 81 may harden and jam the nozzle 813 over time, requiring replacement of the dispenser 81. During replacement, the screw is rotated in a reverse direction to detach the screw from the first latching portion 8113 of the nozzle valve 811. The supporting member 86 is then disassembled from the support frame 20, and the dispenser 81 is disassembled from the fixing member 85. Finally, the first fastening member 88 is rotated in a reverse direction to detach the threaded portion 883 from the actuating shaft 815. Thus, the dispenser 81 is disassembled from the second supporting board 863 and the dispenser 81 can be replaced.

Figure 9:
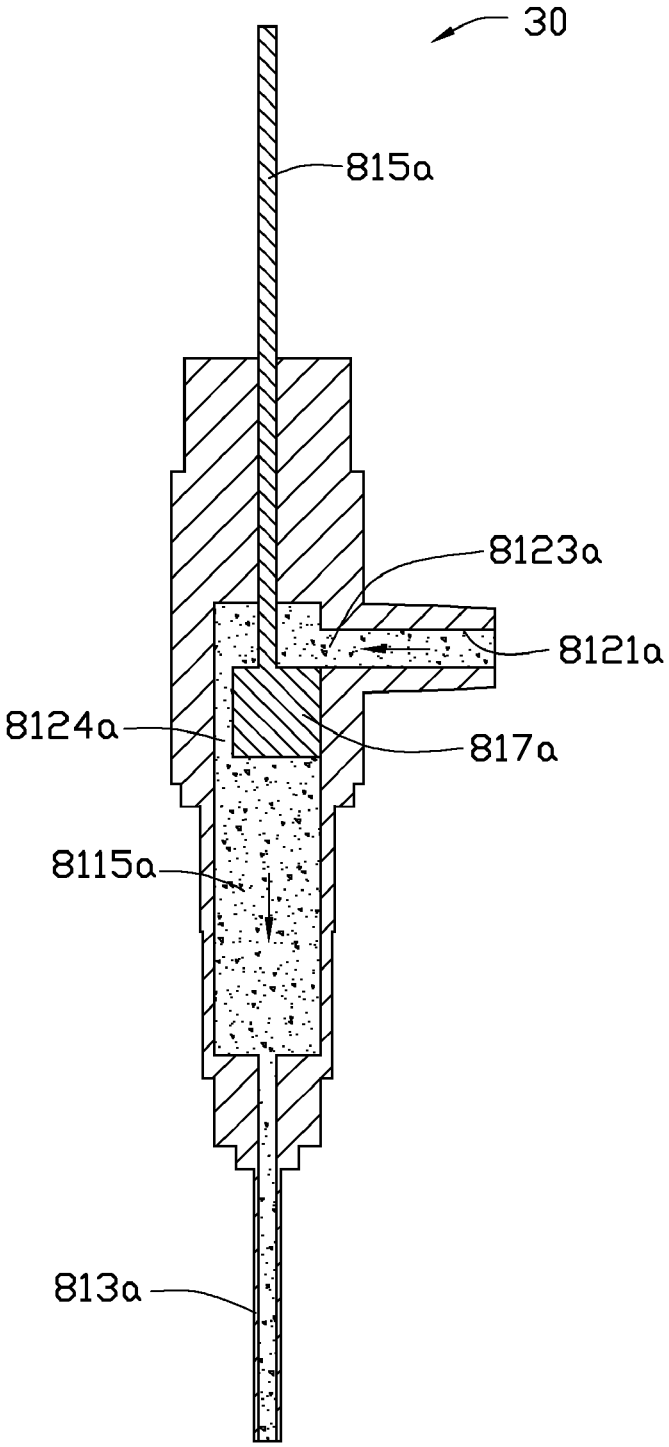
FIG. 9 is an enlarged, cutaway view of a second embodiment of a dispenser in an open state.
Figure 10:
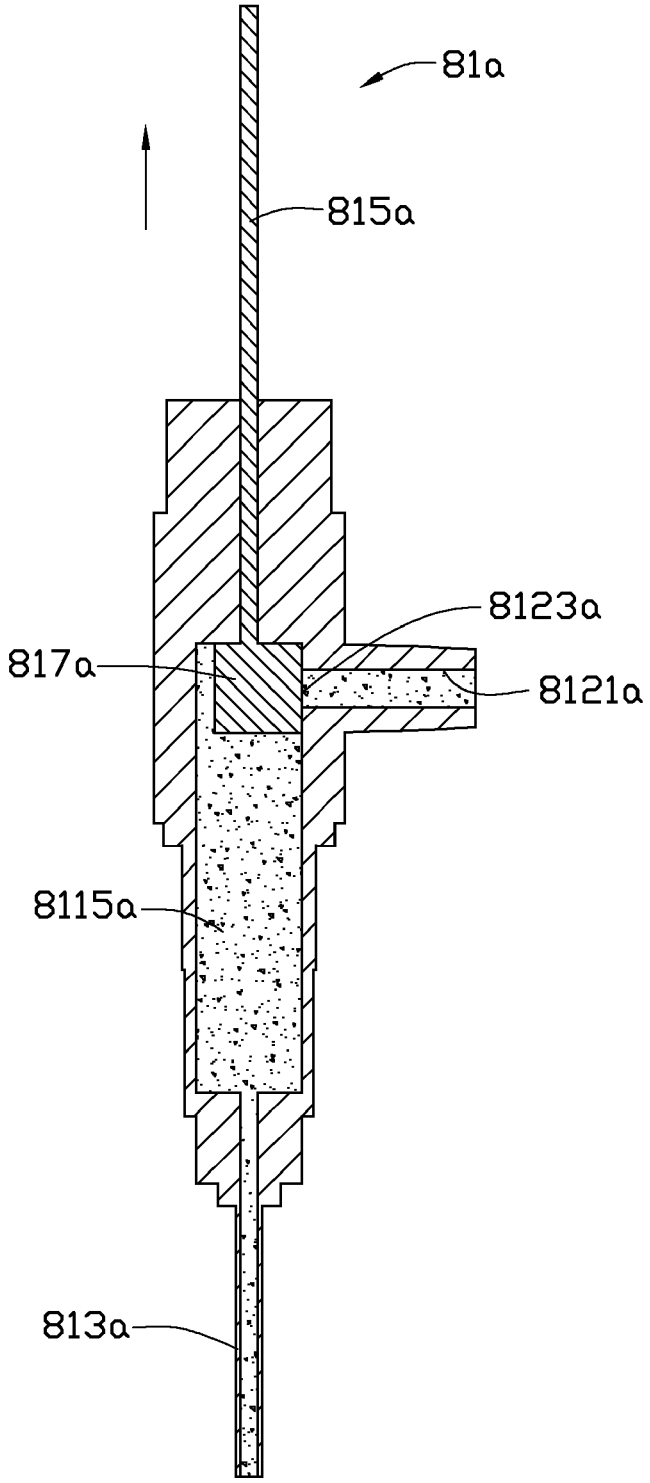
FIG. 10 is similar to FIG. 7, but the dispenser in a closed state.

Referring to FIGS. 9 and 10, a dispenser 81*a* in accordance with a second embodiment of the present disclosure is shown. The dispenser 81 a differs from the dispenser 81 only in that a receiving cavity 8115*a* is substantially cylindrical, and the valve plug 817*a* is also substantially cylindrical, although with a circumference less than that of the receiving cavity 8115*a*. A side surface of the valve plug 817*a* facing the inlet opening 8123*a* contacts a sidewall of the receiving cavity 8115*a*, and a gap 8124*a* is defined between the other side surface of the valve plug 817*a* away from the inlet opening 8123*a* and the sidewall of the receiving cavity 8115*a*. When the dispenser 81*a* is turned to the on (open) state, the valve plug 817*a* is positioned in a middle portion of the receiving cavity 8115*a* and opens the inlet opening 8123*a*. When the dispenser 81*a* is to be turned on as shown in FIG. 9, glue material can be discharged from the channel 8121*a* to an upper portion of the receiving cavity 8115*a*, then flowed to a lower portion of the receiving cavity 8115*a* through the gap 8124*a*, and finally dispensed through the nozzle 813*a*.

When the dispenser 81*a* is to be turned off as shown in FIG. 10, the actuating shaft 35 is moved immediately upward, such that the valve plug 817*a* moves away from the nozzle 813*a* and seals the inlet opening 8123*a*. The dispenser 81*a* can easily return to the on (open) state again by moving the valve plug 817*a* to be near the nozzle 813*a* to open the inlet opening 8123*a*.

It is to be understood that the configurations of the first fastening member 88, and the second fastening member 85 are not limited to those described in the embodiments. For example, they can also be pins. The first fastening member 88 and the second fastening member 85 can be omitted, as long as the two ends of the dispenser 81 can be latched or fixed to the fixing member 85 and the second supporting board 863, respectively. If the replacement of the dispenser 81 is not desired, the fixing member 85 and the second supporting board 863 can also be omitted. The driving device 83 and the supporting member 86 can further be omitted, as long as the actuating shaft 815 is driven manually, and the dispenser 81 is fixed to the support frame 20 by other means such as fasteners.

It is believed that the present embodiments and their advantages will be understood from the foregoing description, and it will be apparent that various changes may be made thereto without departing from the spirit and scope of the disclosure or sacrificing all of its glue material advantages.

What is claimed is:

1. A dispensing apparatus, comprising:

a support frame;

a receiving tube fixed to the support frame, the receiving tube defining a tube cavity for receiving glue material, and an output tube communicating with the receiving tube;

a dispenser connected to the receiving tube, the dispenser comprising:

a nozzle valve comprising a receiving cavity defined therein to contain the glue material, and an inlet tube defined in a sidewall thereof to communicate with the cavity, the inlet tube communicating with the output tube;

a valve plug disposed inside the cavity;

an actuating shaft extending through an end of the nozzle valve, and connected to the valve plug; and a nozzle disposed at the other end of the nozzle valve opposite to the actuating shaft; wherein the actuating shaft moves the valve plug away from or closer to the nozzle so as to close or open the inlet opening, respectively; and a slide rail fixed on the support frame, and a sliding member slidably connected to the slide rail;

a screw rod engaging with the sliding member;

a driving assembly driving the screw rod to move, wherein the driving assembly comprises a driving motor, a driving wheel, an action wheel, and a belt; the driving motor is fixed on the support frame, and the driving wheel is connected to the driving motor; an end of the screw rod is fixed to the action wheel, and the belt is sleeved on the driving wheel and the action wheel; and a push piston fixed on the sliding member, and partially received in the receiving tube for pushing glue material to the dispenser.

2. The dispensing apparatus of claim 1, wherein the valve plug is substantially conical, and has an increasing width towards the nozzle; the receiving cavity comprises a first receiving portion having a shape similar to the valve plug and a second receiving portion communicating with the first receiving portion; the inlet tube communicates with the first receiving portion; and a gap is defined between the valve plug and a sidewall of the second receiving portion.

3. The dispensing apparatus of claim 1, wherein the valve plug is substantially cylindrical, and the cavity is substantially cylindrical with a circumference exceeding that of the valve plug; a side surface of the valve plug facing the inlet opening contacts a sidewall of the cavity; and a gap is defined between the valve plug and the cavity.

4. The dispensing apparatus of claim 1, further comprising a first fixing member and a nozzle sleeve fixed to the first fixing member; the first fixing member defines a through hole to receive the nozzle and the dispenser, and the nozzle passes through the nozzle sleeve.

5. The dispensing apparatus of claim 4, wherein the through hole comprises a first holding portion to receive the nozzle valve, and a second holding portion communicating with the first holding portion to receive the nozzle sleeve.

6. The dispensing apparatus of claim 5, wherein the first fixing member further defines a threaded hole on a side surface thereof communicating with the first holding portion; the dispensing apparatus further comprises a first fastening member comprising a threaded portion received in the threaded hole and abutting the nozzle valve of the dispenser.

7. The dispensing apparatus of claim 1, further comprising a driving device fixed to the support frame, wherein the actuating shaft is connected to and driven by the driving device.

8. The dispensing apparatus of claim 7, wherein the driving device comprises a cylinder body and a piston shaft movably connected to the cylinder body, and the dispensing apparatus further comprises a connecting sleeve interconnecting the piston shaft and the actuating shaft.

9. The dispensing apparatus of claim 8, wherein the connecting sleeve defines a first latching cavity to receive the piston shaft and a second latching cavity communicating with the first latching cavity to receive the actuating shaft.

10. The dispensing apparatus of claim 9, wherein the connecting sleeve further defines a threaded hole thereof communicating with the second latching cavity; the dispensing apparatus further comprises a second fastening member comprising a threaded portion received in the threaded hole and abutting the actuating shaft.

11. The dispensing apparatus of claim 7, further comprising a supporting member fixed to the support frame, the supporting member comprises a base, a first supporting board extending substantially perpendicularly from a middle portion of the base, and a second supporting board extending substantially perpendicularly from an end of the base; the second supporting board defines a through hole to receive the dispenser.

12. The dispensing apparatus of claim 11, further comprises a second fastening member comprising a threaded pole; the support frame defines a restricting groove thereof; the supporting member defines a pin hole thereof; the threaded pole of the second fastening member passes through the pin hole of the supporting member, the restricting groove of the support frame, and engages with a mating fastener, thereby fixing the supporting member to the support frame.

13. The dispensing apparatus of claim 1, further comprises a guide rod and a fixed base fixed to the support frame, the guide rod and the receiving tube are positioned in parallel in the fixed base.

14. The dispensing apparatus of claim 13, further comprises an output tube partially received in the receiving tube, and connected to the dispenser.

15. The dispensing apparatus of claim 13, wherein the receiving tube comprises a main body and a guiding portion connected to the main body, and the guiding portion defines a guiding groove for slidably receiving the guide rod.

* * * * *